United States Patent [19]

Cheze

[11] 4,003,482

[45] Jan. 18, 1977

[54] SAFETY DEVICE FOR A CRANE

[75] Inventor: Bernard J. Cheze, Montceau-les-Mines, France

[73] Assignee: Societe Anonyme dite: Potain Poclain Materiel, Montceau-les-Mines, Saone et Loire, France

[22] Filed: Nov. 19, 1975

[21] Appl. No.: 633,600

[30] Foreign Application Priority Data

Nov. 27, 1972 France ..... 72.42099

Related U.S. Application Data

[63] Continuation-in-part of Ser. No. 416,848, Nov. 19, 1973, abandoned.

[52] U.S. Cl. ..... 212/39; 340/267 C; 212/55; 212/46 R

[51] Int. Cl.[2] ..... B66C 13/48

[58] Field of Search ..... 212/39 R, 39 B, 39 DB, 212/39 MS, 39 A, 46 R, 54–55; 340/267 C; 200/85 R; 235/151.3

[56] References Cited

UNITED STATES PATENTS

| | | | |
|---|---|---|---|
| 2,030,529 | 2/1936 | Nash | 212/39 MS |
| 2,858,070 | 10/1958 | Scharff | 212/39 MS |
| 3,200,963 | 8/1965 | Veimes | 212/39 MS |
| 3,638,211 | 1/1972 | Sanchez | 212/39 MS |
| 3,641,551 | 2/1972 | Sterner et al. | 212/39 R |
| 3,680,714 | 8/1972 | Holmes | 212/39 A |
| 3,724,679 | 4/1973 | Brownell et al. | 212/39 MS |
| 3,740,534 | 6/1973 | Kezer et al. | 212/39 A X |

FOREIGN PATENTS OR APPLICATIONS

| | | | |
|---|---|---|---|
| 993,954 | 6/1965 | United Kingdom | 212/39 MS |
| 1,000,613 | 8/1965 | United Kingdom | 212/39 MS |
| 1,176,943 | 1/1970 | United Kingdom | 212/39 R |
| 171,530 | 10/1965 | U.S.S.R. | 212/39 R |

*Primary Examiner*—Frank E. Werner
*Assistant Examiner*—R. B. Johnson
*Attorney, Agent, or Firm*—Lewis H. Eslinger

[57] ABSTRACT

A safety device for a crane compares two signals, one of which represents the actual load in any configuration of the crane and the other of which represents the permitted or critical load in that configuration, and produces a third signal when the first signal exceeds the second signal. This third signal is used to actuate an alarm device or to prevent a dangerous maneuver from being continued by the crane.

6 Claims, 7 Drawing Figures

SAFETY DEVICE FOR A CRANE

CROSS-REFERENCE TO RELATED APPLICATION

This application is a continuation-in-part of U.S. patent application Ser. No. 416,848 filed Nov. 19, 1973, now abandoned.

BACKGROUND OF THE INVENTION

The present invention relates to safety devices for cranes and in particular to a safety device designed to prevent the lifting of a load heavier than the maximum safe load specified by the crane manufacturer.

FIELD OF THE INVENTION

In variable-inclination and/or variable-length jib cranes designed to lift a load by means of a cable suspended from the end of the jib, the moment of the forces applied to the structure of the crane in any given configuration, due both to the weight of the jib and to the value of the load, can reach a level higher than that of the moment which will cause the crane to tilt in that configuration. Accordingly, the crane has to be provided with a safety device which automatically (or by providing a warning to the crane operator) prevents the operation of the crane from being continued when it is in danger either of causing the installation to tilt or of inducing excessive mechanical or hydraulic stresses in certain components.

DESCRIPTION OF PRIOR ART

Conventional safety devices of this kind often lack precision in their operation when they are simple or, conversely, they are too complex to obtain adequate precision. The more complex safety devices compare the real load applied to the crane in any of its configurations with a critical tilting load, or with the mechanical or hydraulic strength of the crane in that configuration, selected from a range of critical loads which is programmed in accordance with all the various configurations of the crane. The difficulty in such devices arises in determining the critical load of the crane because in order to do so it is necessary, at any one time or for each position, to integrate the length and angle parameters of the jib. These parameters are introduced mechanically and separately into the previously proposed safety devices and result in closure of an electrical circuit through a selection of switches in several sets. The electrical circuit thus selected determines the state of readiness of an alarm, corresponding to the critical load compatible with the integrated parameters, capable of changing to the operative state when the real load becomes equal to this critical load. The disadvantages of such previously proposed devices (for example the device shown in U.S. Pat. No. 3,641,551) are that they are complicated, require constant maintenance, and include a high risk of failure and extreme fragility.

SUMMARY OF THE INVENTION

The object of the present invention is to overcome these disadvantages by simplifying the means for determining the critical load.

In accordance with one aspect of the invention, a safety device for a crane is designed to prevent lifting of a load heavier than the permitted or critical load of the crane of any given position of the crane's jib. In the preferred embodiment, means is provided for comparing two electrical signals, the first of which is indicative of the real load in any configuration of the crane while the second is indicative of the critical load in that configuration of the crane. This comparing means produces a third electrical signal when the first signal is greater than the second. According to the invention, the second or critical load signal is generated from at least one sensor which follows the movement of the point at which the load is applied to the crane in a vertical plane containing the jib which is kept in permanent electrical contact with at least one plane surface made up of flat conductive zones, each of which is at a predetermined potential, these zones forming a network of critical isocharge surfaces.

In one embodiment of the invention, the sensor is in the form of at least one electrical contact stud carrier by a nut, locked against rotation, of a nut-and-screw system, wherein the screw is coupled to rotate with a cable-winding drum. The variations in the length of wound cable corresponds to the variations in the length of the jib of the crane and thus the position of the nut on the screw varies with the length of the jib. The screw is mounted for rotation at one of its ends in a pivot pin which extends perpendicular to the aforementioned plane surface. The pivot pin is integrally connected with the head of a connecting rod whose angular movements about the pin correspond to the angular movements of the jib of the crane in the luffing plane as described hereinafter.

In addition, the aforementioned plane surface in this embodiment of the invention may be in the form of a printed circuit having a plurality of flat conductive zones located in a vertical plane containing the jib of the crane. The potential to which each of these zones is subjected is proportional to the critical load of the crane at the position which the zone represents.

In one modification of the invention, the device comprises two printed circuits arranged parallel to and opposite one another between which the screw-and-nut system referred to above is located. The nut is then provided with two sensors respectively in contact with the printed circuits to form two means for determining the critical load in any configuration of the crane. The sensors can be brought selectively into operation depending on whether the crane is mounted on pneumatic supports or on stabilizers.

DETAILED DESCRIPTION OF THE DRAWINGS

The invention is described by way of example in the following with reference to the accompanying drawings, wherein.

DETAILED DESCRIPTION OF A PREFERRED EMBODIMENT

Figure 1:
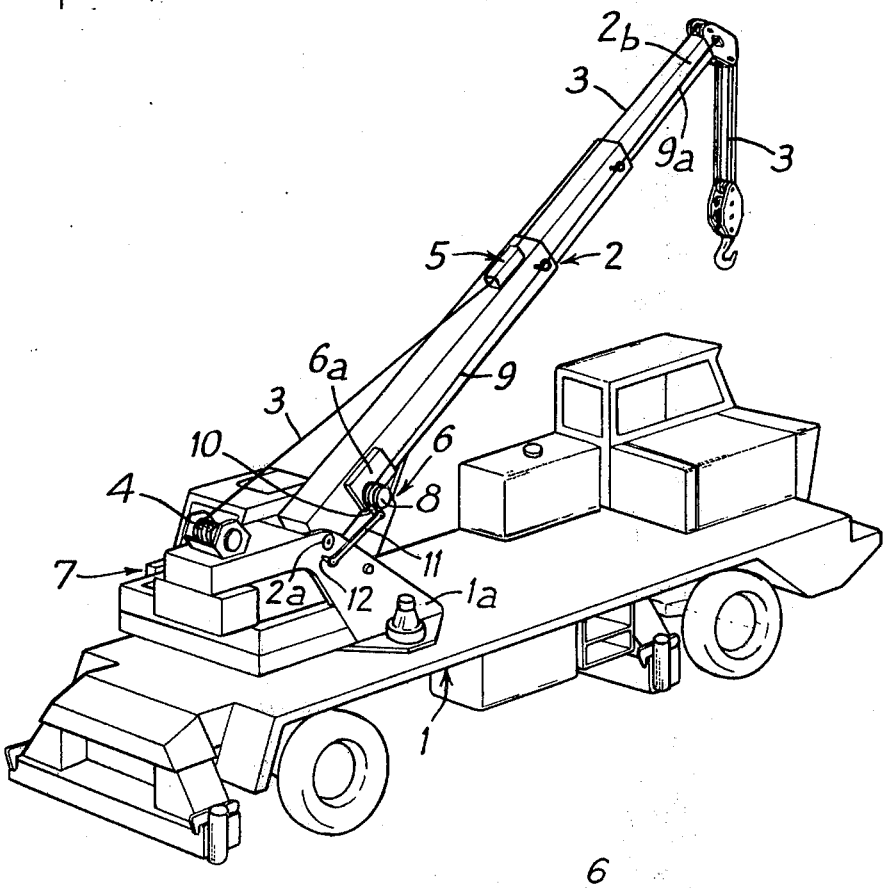
FIG. 1 is a diagrammatic view of the installation of a device according to the invention on a mobile crane equipped with a telescopic jib.

As seen in FIG. 1, a conventional mobile crane includes a supporting chassis 1, a turret 1*a*, a telescopic jib 2 mounted on turret 1*a* for pivotable movement about a pivot pin 2*a*. The file is equipped with a lifting cable 3 fed out from a winch 4 in the conventional manner. In addition to being able to swivel on pivot 2*a*, the jib 2 is also designed to be varied in length and inclination, also in any conventional manner.

The safety device of the present invention includes a first sensor means 5 for detecting the load actually lifted by the jib and delivering a first electrical signal proportional in voltage to this load. A second sensor means 6 calculates or produces, in any configuration of the crane, the critical load not to be exceeded by the crane in that configuration and produces a second electrical signal proportional in voltage to that critical load. A third means or compactor 7 compares the first and second signals and, in one presently preferred embodiment, produces a third signal to control the generation of an alarm signal or bell when necessary.

The first sensor means 5 consists of a combination of (1) a dynamometer and a (2) potentiometer of the commercially available "Linostat" type distinguished in particular by its high precision and absence of drift under the influence of certain parameters, especially temperature.

Figure 6:
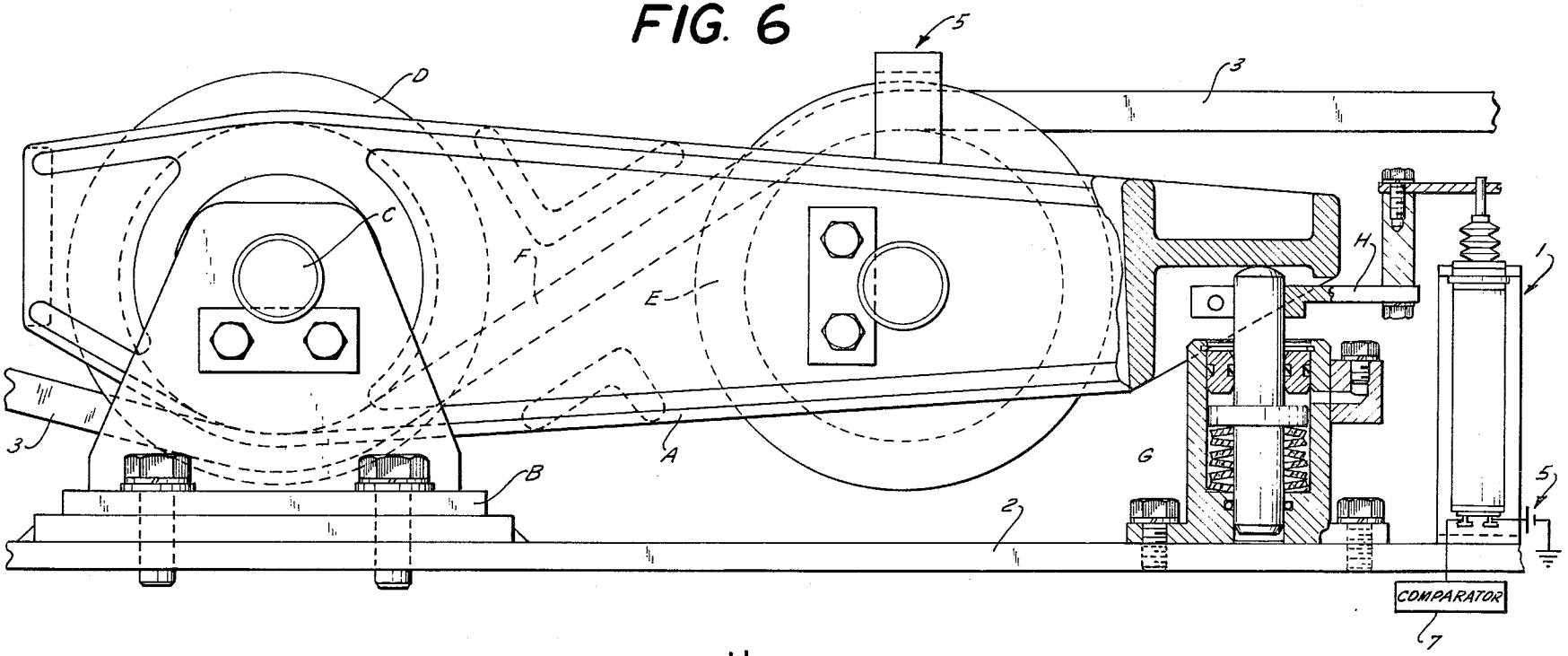
FIG. 6 is an elevational view of the actual load sensor.

As seen in FIG. 6 the sensor 5 includes a lever A pivoted on a support block B (mount on jib 2) about an axis C. This lever is provided with two rollers D and E about which the cable 3 is guided. The free end of the lever A is supported on a spring biased rod G which follows the movement of the free end of lever A. As a result, vertical changes in the position of the free end of the lever are transmitted to the rod G and a coupling element H which is secured thereto.

The element H is connected to a variable "Linostat" type potentiometer of conventional construction which is connected in any convenient manner to a source of voltage 5. Thus as movement of the coupling element H moves the movable contact of the potentiometer, the output voltage signal from the potentiometer varies; i.e. the output voltage signal varies with the position of the end of lever A.

Because of the arrangement of lever A and rollers D and E, when the load on the cable 3 increases, (i.e. when the actual load lifted by the job increases) the tension in the cable also increases and causes the lever A to rotate about its pivot point C. Thus rod G is depressed causing a change in position of the movable driving core or contact of the potentiometer I to vary the output signal of the potentiometer. Of course when the load is decreased the tension in cable 3 decreases and rod G moves up, under the influence of its associated springs thus also raising the potentiometer core. As a result the voltage output signal of the potentiometer is proportional to the tension or actual load on cable 3. This voltage output signal is supplied directly to comparator 7.

Accordingly, this potentiometer combination produces an electrical signal proportional in voltage to the actual load applied to lifting cable 3, whose point of application is located at the end of 2*b* of the jib. In the case of reeving, i.e. when the load is lifted by several cables, with the aid of pulleys, the potentiometer is adjusted by manual or automatic selectors which, by acting on an electronic circuit in known manner, corrects the electrical signal in dependence upon the number of reeved cables and makes it possible to obtain a signal indicative of the load being lifted.

Figure 7:
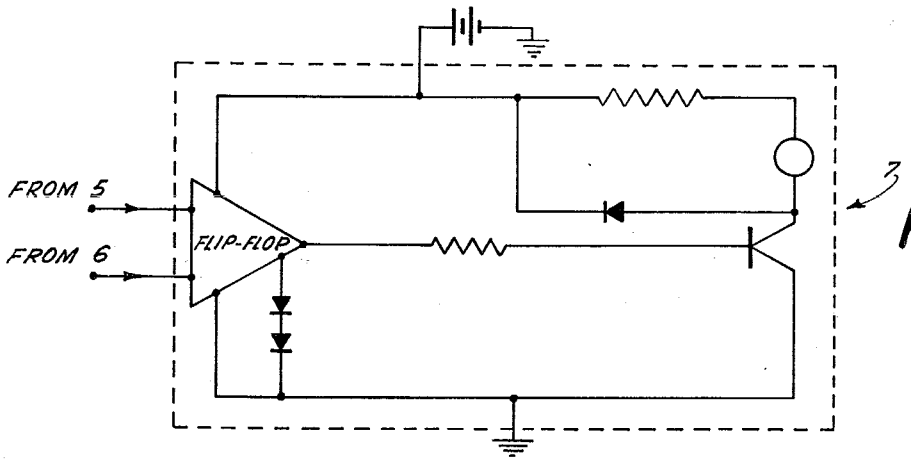
FIG. 7 is a circuit diagram of the comparison means used in one embodiment of the invention.

The third means or comparator 7 is constructed to make a comparison between the first and second electrical signals by means in particular, of a conventional electronic flip-flop circuit, such as is illustrated in FIG. 7. The specific comparator circuit can of course take many forms as would be obvious to those skilled in the art since its function is simply to compare two electrical input voltage signals and produce an output voltage signal when one of the input signals is greater than the other. Thus the specific circuit need not be described in detail since almost any comparator circuit can perform this function.

Finally, the second sensor means 6, which forms a second electrical input signal to the comparator proportional to the critical load for this jib, comprises several elements some of which are shown in FIG. 1. Thus, it can be seen that this second sensor means 6 consists in particular of a casing 6*a* fixed to jib 2, outside which are shown a winding drum 8 for a cable 9 fixed at its end 9*a* to the end of 2*b* of the jib 2 and a connecting rod 10 coupled at its base to an element 11 which is connected to the turret 1*a* of the mobile crane to pivot about a pin 12.

The head of the connecting rod 10 is itself pivotally connected to a pin integral with the jib 2 of the mobile crane. Accordingly, by means of this device, when the inclination of the jib is altered the connecting rod 10 is displaced parallel to itself because the jib, the element 11, that section of the turret between the pin 2*a* and the pin 12 and the connecting rod 10 form a link parallelogram one of whose sides, namely the line passing through 2*a* and 12, remains fixed. Accordingly, the connecting rod 10 always remains vertical or parallel to its initial position, regardless of the inclination of the jib 2.

A detailed embodiment of the aforementioned second sensor means 6 will now be described with reference to FIGS. 2, 3 and 4.

Figure 2:
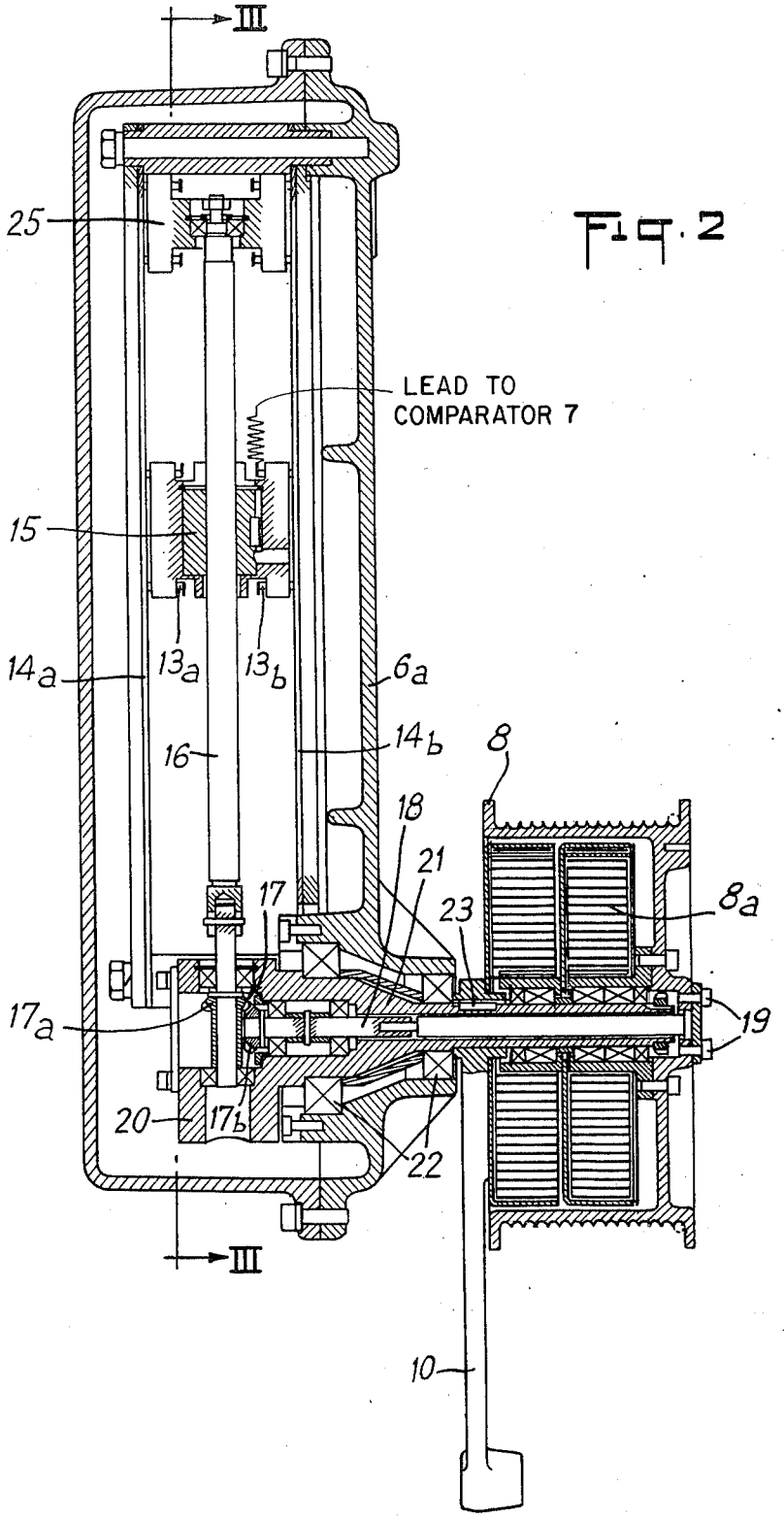
FIGS. 2 and 3 are detailed views of the means for generating the aforementioned second signal, FIG. 2 being a section on the line II—II of FIG. 3 and FIG. 3 a section on the line III—III of FIG. 2.

As shown in FIG. 2, the casing 6*a* accommodates two sensors 13*a* and 13*b* following the movement of the point at which the load is applied to the crane, and two plane surfaces 14*a* and 14*b* made up of flat conductive zones each of which is at a predetermined potential. The two sensors 13*a* and 13*b* are carried by a nut 15, locked against rotation, of a screw-and-nut system of which the screw 16 is capable of being turned about its own axis by means of a pair of conical pinions 17, a pinion 17*a* being keyed to one end of a pin 18 integral with the winding drum 8 by means of screws 19 so as to rotate therewith. The winding drum 8 is equipped with an internal spring return mechanism 8*a* which keeps the cable 9 under constant tension. The screw 16 is kept in alignment by a housing 20 at the level of the pair of conical pinions 17. The housing 20 itself comprises a hollow shaft 21 coaxial with the pin 18 which opens outside the casing 6*a*. It is kept in alignment, for example, by ball bearings at the level of two bearings 22 accommodated in the casing 6*a*. This shaft 21 is designed to be rotated relative to the frame 6*a* by means of the connecting rod 10 whose head is keyed for rotation by means of a key 23. Accordingly, this movement which is made possible by virtue of the free rotatable mounting of the shaft 21 in the frame 6 enables screw 16 to pivot about shaft 21 in a plane parallel to the two surfaces 14*a* and 14*b*.

The sensors 13*a* and 13*b* are in permanent contact with the surfaces 14*a* and 14*b* which are fixed to the casing 6*a*. These surfaces are in particular printed circuits of which one embodiment is illustrated in FIG. 4.

Figure 3:
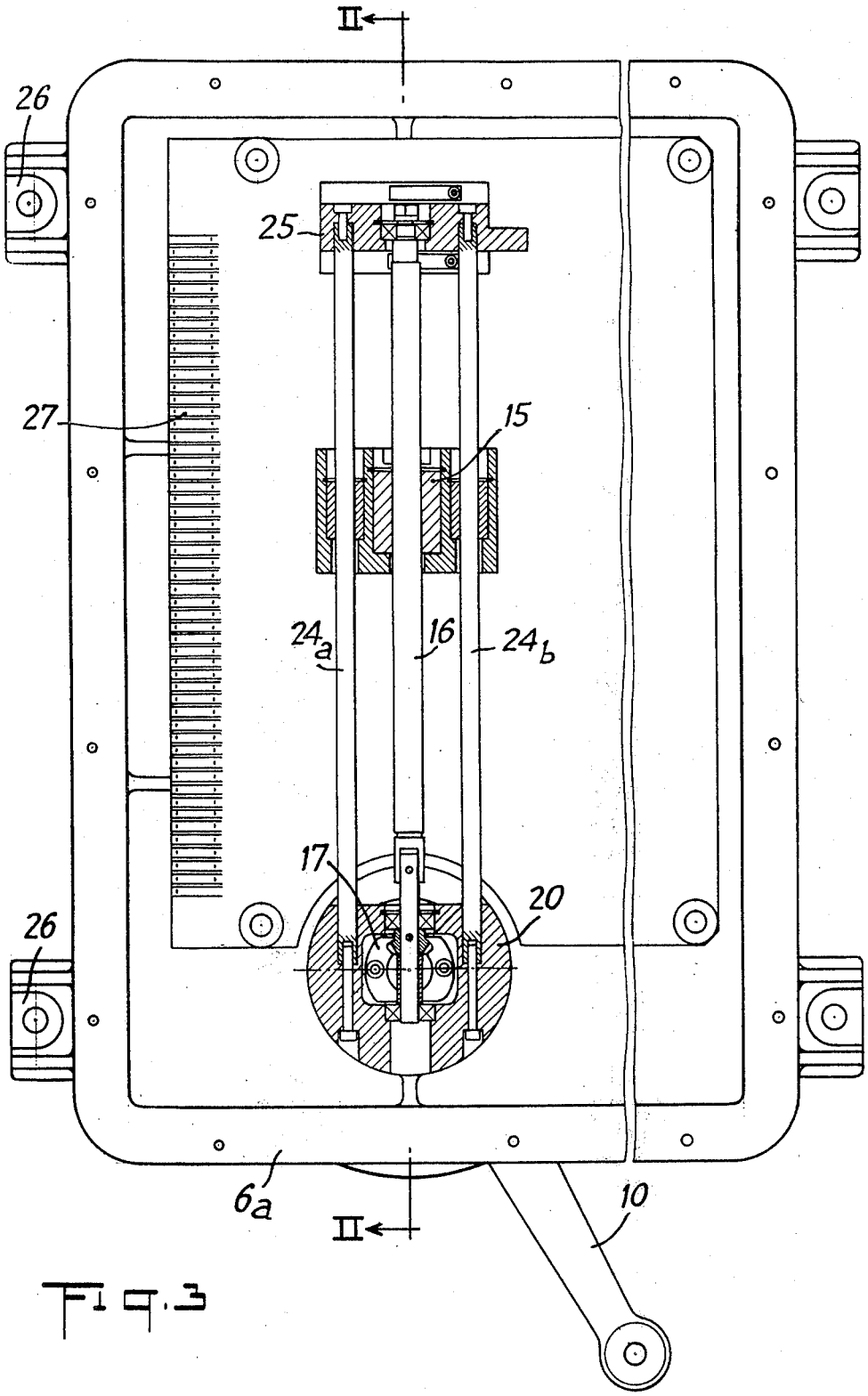

FIG. 3 shows some of the components appearing in FIG. 2 using the same reference numerals. It can be seen that the nut 15 is locked against rotation by means of two guides 24*a* and 24*b* which, at one of each of their ends, are fixed to the housing 20 and, at the other of each of their ends, are held by a member 25 which, at the same time, guides the screw 16 in rotation about its own axis. FIG. 3 also shows the presence of lugs 26 by which the casing 6*a* may be fixed to the jib 2, the connecting zones of the various conductive areas of the surface 14*b* being shown in outline at 27.

Figure 4:
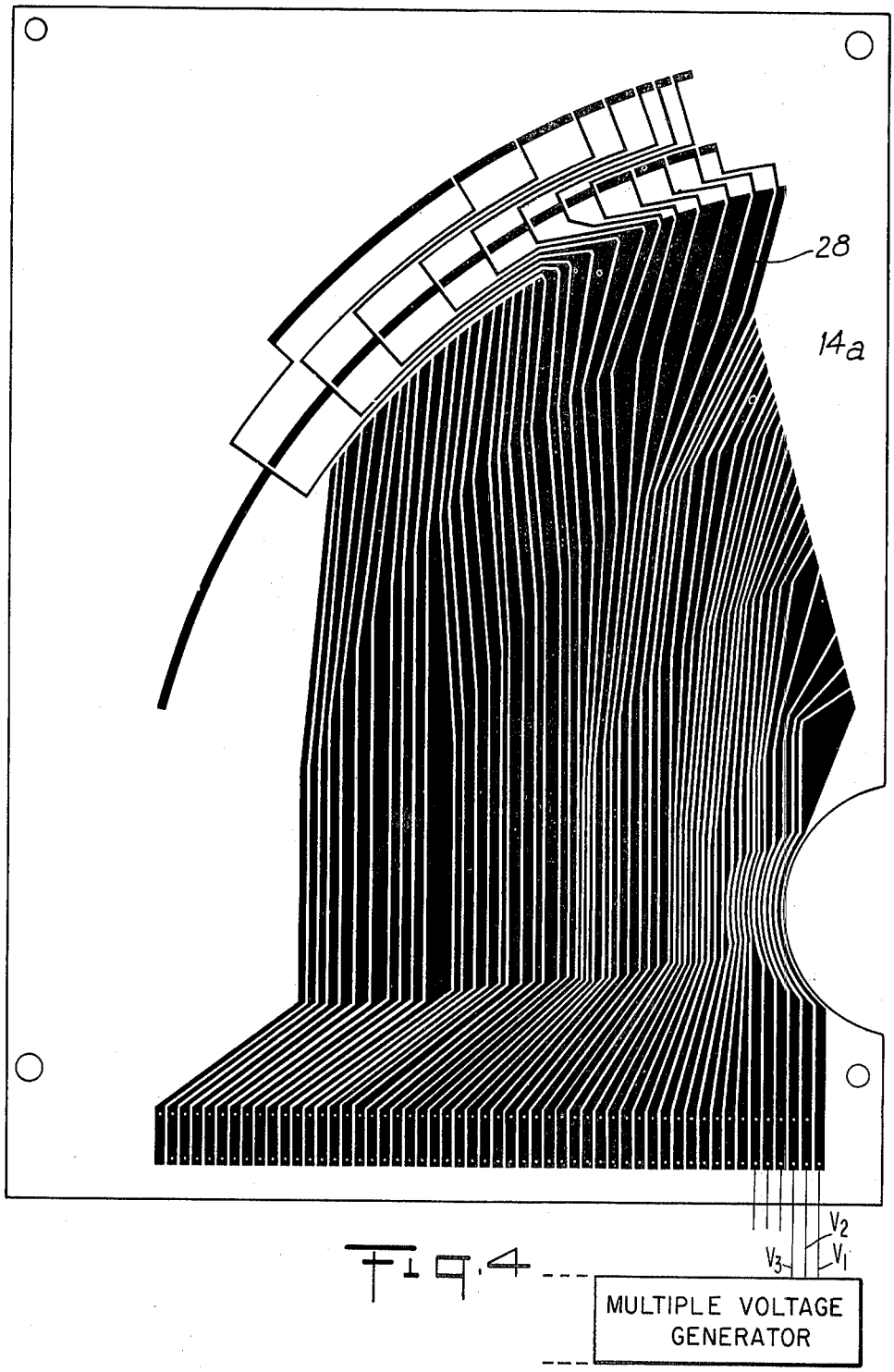
FIG. 4 is a plan of the aforementioned printed circuit.

FIG. 4 shows the plate 14*a*, to which, of course, plate 14*b* corresponds.

Experiments have been conducted to determine the position, in the vertical plane containing the jib, of the points at which a load is applied to the jib of the crane, which causes the crane to tilt or induces excessive stressing in certain mechanical or hydraulic components when the jib changes configuration. The load is then referred to as a critical or nominal load. The same experiment was conducted repeatedly, the value of the load being changed on each occasion. A network of surfaces known as "critical or nominal isocharge surfaces" was obtained in this way in the vertical plane containing the job of the crane.

This network of critical isocharge surfaces, each rendered conductive, was then reproduced on a reduced scale compatible with the mechanical parameters of the screw-and-nut system and of the winding drum 8. FIG. 4 shows one embodiment of this reduction realized with the aid of printed circuits. Each area or surface 28 has a connecting zone 27 so that there can be applied to it a voltage ($V_1$, $V_2$, $V_3$, etc. as seen in FIG. 4) proportional to the value of the load selected for determining its characteristic. These voltages are supplied to the isocharge areas 28 in any convenient manner, as for example by the use of separate voltage sources or any well known and commercially available multiple voltage generator which provide separate voltage outputs of varying values connected to the respective surface areas. These voltages supplied to areas 28 are of course compatible with the voltage supplied by the first sensor means 5 for measuring the real load.

The mode of operation of the crane safety device according to the invention as explained in the following will make its principal advantages clear.

Figure 5:
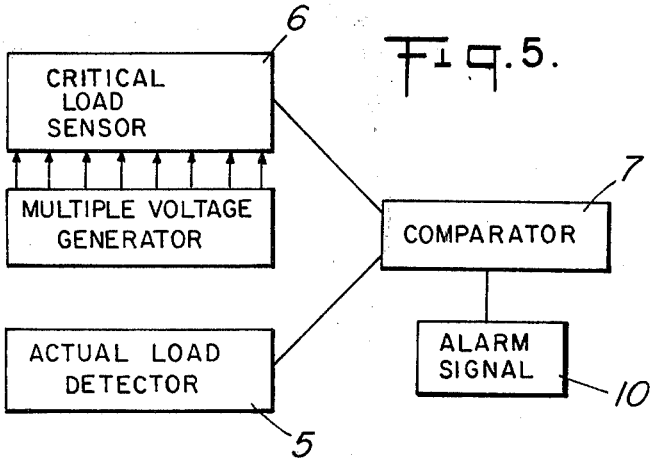
FIG. 5 is a schematic block diagram of the operating circuit used in accordance with the present invention.

It is assumed that a load is attached to the cable 3 (FIG. 1). The value of this load is detected by the first sensor means 5 which delivers a first signal to the comparison means 7. At the same time, the second sensor means 6 delivers a second signal to the comparison means 7. The circuit diagram showing the connection of the various elements 5, 6, and 7 which produce the output or alarm signal described hereinafter, is shown in FIG. 5.

The voltage of the second signal is proportional to the critical tilting load in the configuration of the crane at the moment at which it is delivered. In effect, the length of the jib 2 is introduced into the second sensor means 6 by the varying of the wound length of cable 9 on the drum 8 (FIG. 1) as the jib is extended and retracted, since the cable 9 has one end 9*a* connected to the end 2*b* of the jib 2 to move therewith and is under constant tension from spring mechanism 8*a*. This variation in winding results in rotation of drum 8, which in turn rotates the pin 18 and, through the pair of conical pinions 17, turns screw 16 about its own axis (FIG. 1). The nut 15, being locked against rotation by the guides 24*a* and 24*b*, ascends or descends along the screw 16 depending on whether the jib is lengthened or shortened. Accordingly, it can be seen that, through these first components, the position of the nut 15 on the screw 16 is indicative of the length of the jib 2.

On the other hand, casing 6*a* is fixed to jib 2 of the crane. Accordingly, the casing follows the inclinations of the jib in the same way as the surfaces 14*a* and 14*b*, which are attached to the casing. Now, the inclination of the screw 16/nut 15 system in the plane of FIG. 3 is controlled by the housing 20, its extension being formed by the shaft 21 and the connecting rod 10 (FIG. 2). As already explained with reference to FIG. 1, this connecting rod 10 always remains parallel to its initial position, so that the screw/nut system also remains parallel to its initial position irrespective of the inclination of the jib. Accordingly, there is relative angular movement between screw 16 and the surfaces 14*a* and 14*b* which translates the variations in the inclination of the jib 2.

The addition of this angular movement of the screw 16 and of the relative movement of the nut 15 along the screw has the effect that the nut, which carries the sensors 13*a* and 13*b*, immediately and homothetically copies the movement of the point of application of the load in the luffing plane of the jib in all the configurations thereof. The reference plane representing the vertical plane in this homothetic system is formed by one of the surfaces 14*a* or 14*b*.

In a given handling operation, only one of the surfaces 14*a* or 14*b* is in service. The reason for this is that, since their realization is empirical, they only correspond respectively to a single mode of application of the crane, for example the crane being keyed to pneumatic supports for the surface 14*a* and to stabilizers for the surface 14*b*. Assuming that the surface 14*a* is in service, i.e. fed with each of the voltages corresponding to each of its conductive zones, the sensor 13*a*, being kept in constant contact with it, collects the voltage proportional to the critical or nominal load corresponding to the configuration of the jib at any instant. This voltage is then supplied to the comparison means 7.

It may be that the sensor 13*a* is in contact with two consecutive flat zones. A conventional electronic device (not shown) then comes into operation in known manner to work out the arithmetic mean of the two voltages thus collected and transmits the result to the comparison means 7.

The comparison made in comparator 7 is made between a first voltage (from potentiometer I) proportional to the load actually being lifted and a second voltage (from panel 14) proportional to a permitted or nominal load. The comparison is made by means of a conventional electronic flip-flop circuit (FIG. 7) which produces an electrical signal when the difference between the second and the first voltages becomes negative. After amplification, this signal acts to automatically control certain functions of the jib, e.g. it can be used to prevent lifting of the hook, to increase the length of the jib or its angular descent, or as to prevent a dangerous manoeuvre from being continued as by stopping operation of the crane controls or, preferably, to set off an alarm system such as a bell 70 or alarm light in the cab of the crane.

One of the advantages of the safety device according to the invention is embodied in the simplicity with which the geometric parameters relating to the crane are integrated. This integration is automatic and takes place instantaneously which enables dangerous working conditions to be immediately detected.

The design of this safety device also enables it to be fitted to any type of crane with a limited number of adjustments and adaptations, in particular by changing the printed circuits specifically designed for each type of crane. It also enables the crane to be adapted to the different working conditions of the transporter as a function of its stabilization associated with a position detector acting on the electronic circuit to introduce a correction factor into it. The device according to the invention can also take into account the nature of the terrain to which it is anchored, and even the slope on which it is working.

In addition, since the crane is often equipped with a jib and with a boom, the safety device safeguards the loads lifted by the boom in the same way as the loads lifted by the jib.

Finally, it is mounted externally on the crane which is extremely advantageous so far as maintenance and repair work is concerned.

The invention can be applied with advantage in the field of mobile cranes and public works.

Although the present invention has been described with reference to the accompanying drawings, it is not limited to that precise embodiment, and various changes and modifications can be effected therein without departing from the scope or spirit of the invention.

What is claimed is:

1. A safety device for a crane having a chassis, and an extensible jib pivotally mounted on said chassis for pivotal movement in a vertical plane, said crane including means on the jib for raising and lowering a load, said device comprising means for producing a first signal indicative of the actual load in any configuration of said jib with respect to the chassis of the crane, means for producing a second signal proportional to the critical load above which the crane may tilt at substantially every position which can be assumed by said jib with respect to said chassis, said second signal producing means comprising at least one sensor means operatively connected to said jib for following the movement of the point at which the load is applied to the crane and assuming positions representative of that point corresponding respectively to the instantaneous vertical angular position and extension of the jib, at least one flat surface comprising a plurality of conductive flat zones of predetermined configuration, each of which is at a different predetermined electrical potential representative of different critical loads for the crane, said sensor means being in permanent electrical contact with said flat surface to produce said second signal from the flat zone it is in contact with at any given instant, said flat zones forming a network of critical isocharge surfaces each of which has a predetermined configuration selected in accordance with their predetermined electrical potential to apply to said sensor means a signal which is proportional to the critical load for the crane at each possible position of the jib, and means operatively connected to said first and second signal producing means for comparing said first and second signals and producing a third signal when said first signal is greater than said second signal whereby said third signal provides an indication that the actual load on the crane is greater than the permissible critical load for the instantaneous position of the crane's jib.

2. A safety device as defined in claim 1 wherein said sensor means includes a drum rotatably mounted on said chassis, a cable operatively connected at one end to said drum and at its opposite end to said jib adjacent the point at which the load is applied to the jib, means for biasing said drum in rotation to wind said cable on the drum, whereby rotation in opposite directions of said drum represents extension and retention of said jib and variations in the wound length of cable on the drum corresponds to variations in the extension of the jib, a screw threaded rod operatively connected to said drum for rotation therewith, a traveling nut threadably mounted on said rod; and means for holding said nut against rotation whereby rotation of said drum cause said rod to rotate and said nut to move along said rod; at least one electrical contact stud mounted on said nut in permanent electrical contact with said flat surface for engaging said contact zones and producing said second signal.

3. A safety device as defined in claim 2 wherein said flat surface and conductive zones are secured to said jib for movement therewith and said sensing means includes means for maintaining said threaded rod in a predetermined position with respect to the vertical during movement of the jib whereby said flat surface is displaced angularly with respect to the threaded rod in accordance with the angular displacement of the jib.

4. A device as defined in claim 3 wherein said maintaining means comprises means operatively connected to said threaded rod for defining a parallelogram linkage having a fixed side and one side of which is formed by said jib.

5. A safety device as claimed in claim 3, wherein said flat surface is in the form of a printed circuit in which each of the flat conductive zones which it determines is the image on a reduced scale, in the vertical plane containing the jib of the crane, of the assembly of points at which the maximum permitted load, proportional to the potential to which the aforementioned zone is subjected, are applied to the crane.

6. A safety device as defined in claim 5, including at least one pair of printed circuits parallel to and opposite one another, said traveling nut being positioned therebetween, said nut having two contact studs in contact with each of the aforementioned printed circuits to form two means for determining the critical load in any configuration of the crane, and being brought selectively into service depending on whether the crane is on pneumatic supports or on stabilizers.

* * * * *